US008104435B2

(12) United States Patent
Schwartz et al.

(10) Patent No.: US 8,104,435 B2
(45) Date of Patent: Jan. 31, 2012

(54) COOLING FAN CONTROL

(75) Inventors: William Samuel Schwartz, Pleasant Ridge, MI (US); Allan Roy Gale, Livonia, MI (US); Dinakara Karanth, Northville, MI (US); Steven James Parks, Royal Oak, MI (US); Garrett O'Donohue, Livonia, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 12/766,762

(22) Filed: Apr. 23, 2010

(65) Prior Publication Data

US 2011/0132292 A1 Jun. 9, 2011

(51) Int. Cl.
*F01P 7/02* (2006.01)

(52) U.S. Cl. ..... 123/41.12; 180/68.1; 180/68.2; 180/68.4; 180/68.6

(58) Field of Classification Search ..... 123/41.12; 180/68.1, 68.2, 68.4, 68.6; 318/139
See application file for complete search history.

(56) References Cited

U.S. PATENT DOCUMENTS

| | | | | |
|---|---|---|---|---|
| 2,506,520 | A * | 5/1950 | Spase | 192/15 |
| 2,807,246 | A * | 9/1957 | Jacobs | 123/41.12 |
| 4,074,663 | A * | 2/1978 | Cory | 123/41.12 |
| 4,469,053 | A * | 9/1984 | Sakurai | 123/41.12 |
| 4,881,494 | A * | 11/1989 | Ishigami | 123/41.12 |
| 5,667,045 | A * | 9/1997 | Cummings, III | 192/18 A |
| 5,947,248 | A * | 9/1999 | Link | 192/84.1 |
| 6,603,277 | B2 | 8/2003 | Yoshimura | |
| 6,745,727 | B1 * | 6/2004 | Kramer et al. | 123/41.11 |
| 6,807,926 | B2 | 10/2004 | Shiozaki et al. | |
| 7,603,968 | B2 | 10/2009 | Pantow | |
| 2008/0257286 | A1 | 10/2008 | Harich et al. | |
| 2008/0283215 | A1 | 11/2008 | Saida et al. | |

* cited by examiner

*Primary Examiner* — Michael Cuff
*Assistant Examiner* — Hung Q Nguyen
(74) *Attorney, Agent, or Firm* — Julia Voutyras; Alleman Hall McCoy Russell & Tuttle LLP

(57) ABSTRACT

Methods and systems are provided for reducing aerodynamic drag on a moving vehicle. One example method comprises, during a first vehicle moving condition, operating the cooling fan, and during a second vehicle moving condition, selectively applying a braking torque on the fan.

18 Claims, 3 Drawing Sheets

COOLING FAN CONTROL

FIELD

The present description relates to methods and system for controlling a cooling fan of a vehicle cooling system.

BACKGROUND AND SUMMARY

Vehicle cooling systems may include various cooling components such as heat exchangers, radiators, cooling fans and blowers, condensers, liquid coolant, etc. Additionally, the cooling system may receive cooling intake air from a front end of the vehicle, for example, through a vehicle or bumper opening, to assist in cooling the engine, transmission, and other components of the under-hood region. Such front-end air flow may add aerodynamic drag when the vehicle is in motion.

Various approaches may be used to reduce vehicular aerodynamic drag. One example approach is illustrated by Harich et al. in US 2008/0257286A1. Herein, the opening of one or more shutters and pivotable flaps in the frame of a vehicle cooling system may be adjusted, based on engine operating conditions, to thereby alter a total front end air-mass flow. Specifically, by adjusting the flaps and shutters of a variable geometry intake frame based on engine cooling demands, a cooling air flow through a blower and/or a coolant cooler may be adjusted. By restricting the shutters and/or flaps, for example, during conditions of low external air temperatures, air-flow and related aerodynamic drag may be reduced.

However, the inventors herein have recognized potential issues with such an approach. In one example, when the vehicle is moving, despite shutter and flap adjustments, some air may enter through the front end of the vehicle and rotate the blades of an unpowered fan of the cooling system. The free-wheeling fan may thereby lower cooling system resistance relative to a stationary fan which is not free-wheeling. The increase in cooling airflow thus generated when no cooling airflow is otherwise desired may lead to an increased cooling drag. As such, this may augment vehicular aerodynamic drag, thereby reducing vehicle performance and fuel economy.

Thus, in one example, some of the above issues may be addressed by a method of controlling a cooling fan of a vehicle cooling system comprising, during a first vehicle moving condition, operating the cooling fan, and during a second vehicle moving condition, selectively applying a braking torque on the fan. The first vehicle moving condition may include a request for airflow assistance from the cooling fan. The second vehicle moving condition may include no request for airflow assistance. Such an approach may be used with or without shutters or flaps, for example.

In one example, during a first vehicle moving condition, airflow assistance may be requested, for example, due to one or more under-hood components being heated above a threshold temperature. For example, an engine coolant temperature may be above a threshold, and airflow assistance may be requested to assist the radiator in cooling the coolant. Accordingly, a cooling fan of the vehicle's cooling system may be driven using power from the engine. During a second vehicle moving condition, airflow assistance may not be requested. Herein, the flow of air through under-hood components, due to the vehicle's motion, may provide sufficient airflow such that additional airflow assistance from a cooling fan is not required. As such, the fan may be "free-wheeling", that is, the fan may be rotating due to the flow of ram air through the fan blades, and may not be driven by the engine. During such a free-wheeling condition, an engine controller may selectively apply a braking torque on the rotating fan blades to stop or reduce fan rotation.

For example, the braking torque may be selectively applied during a condition where the vehicle speed is above a minimum speed and the coolant temperature is below a lower threshold. Herein, the lower coolant temperature may not necessitate airflow assistance from the cooling fan. However, the rotation of the free-wheeling fan, while the vehicle is moving at the higher speed, may increase drag on the moving vehicle and reduce fuel economy. The drag may also reduce vehicle performance. Thus, during such a condition, a braking torque may be applied on the fan to reduce fan rotation (for example, reduce to a minimum speed or reduce to a halt). By selectively stopping or reducing fan rotation, air flow through the fan may be reduced when possible, thereby reducing the related aerodynamic drag. In one example, applying a braking torque may include shorting the power feed of an electric fan's motor so that the back EMF generated by the motor attached to the free-wheeling fan provides the braking torque. In another example, the braking torque may be applied mechanically, for example, using a latch or pin. Further, the braking torque may be adjusted based on vehicle operating conditions.

In this way, by selectively reducing free-wheeling of a cooling fan in a moving vehicle, based on operating conditions, cooling airflow across the fan may be reduced under selected conditions, thereby reducing cooling drag when such airflow is not otherwise needed. By reducing cooling aerodynamic drag when possible, vehicle fuel economy may be improved.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 1:
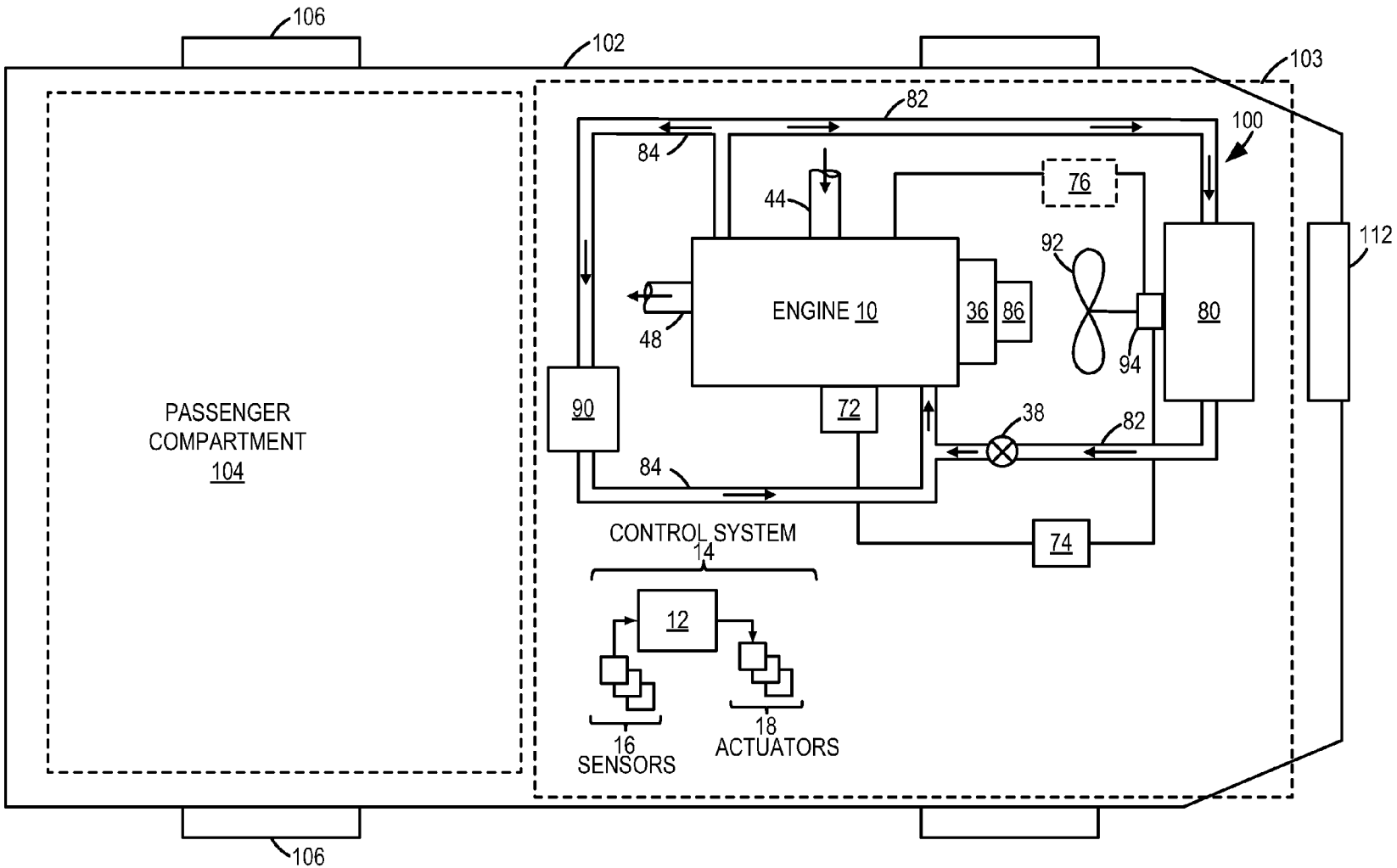
FIG. 1 schematically shows an example embodiment of a vehicle cooling system in a motor vehicle.
Figure 2:
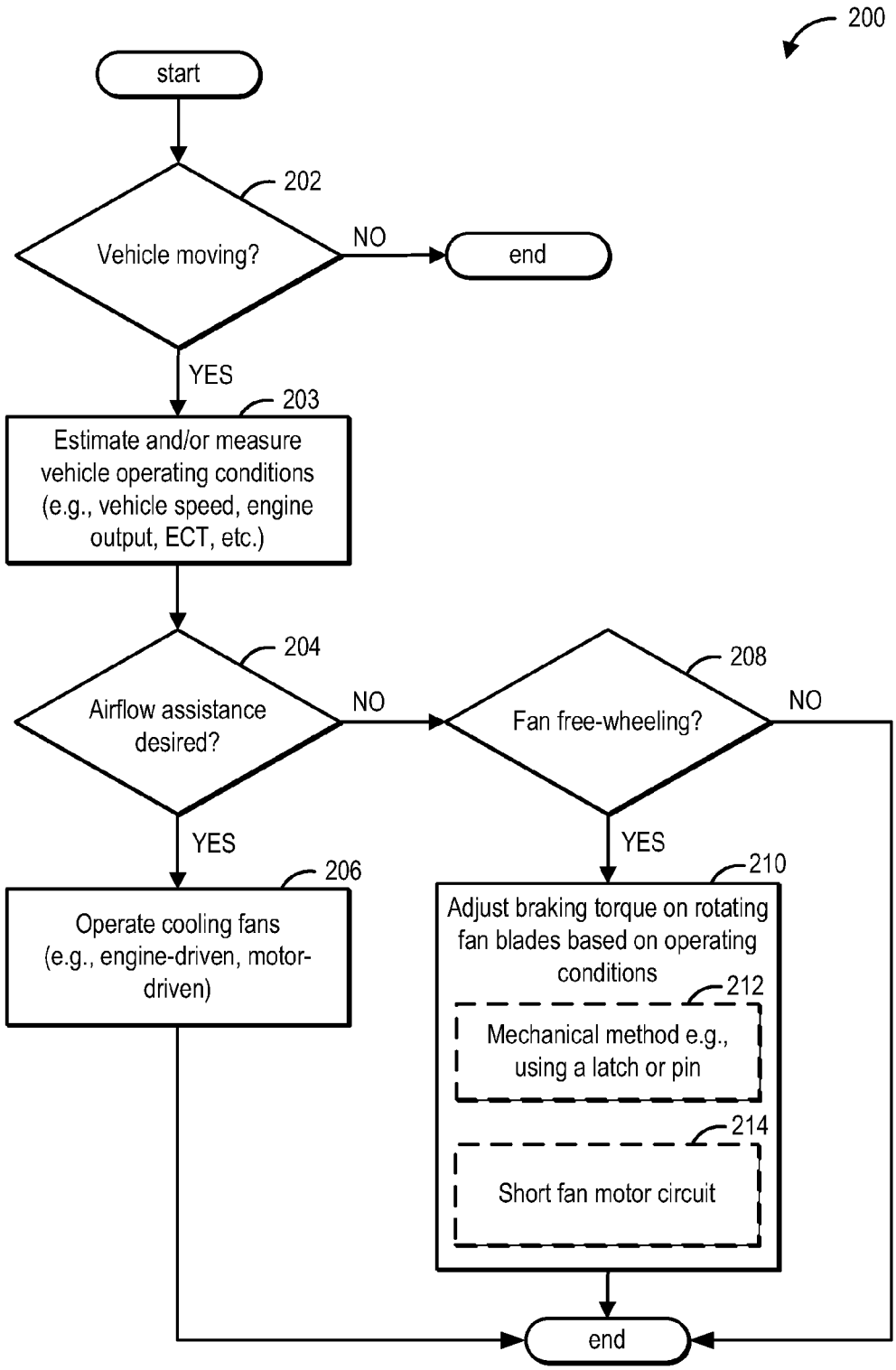
FIG. 2 shows a flow diagram of an example method of operating a cooling fan.
Figure 3:
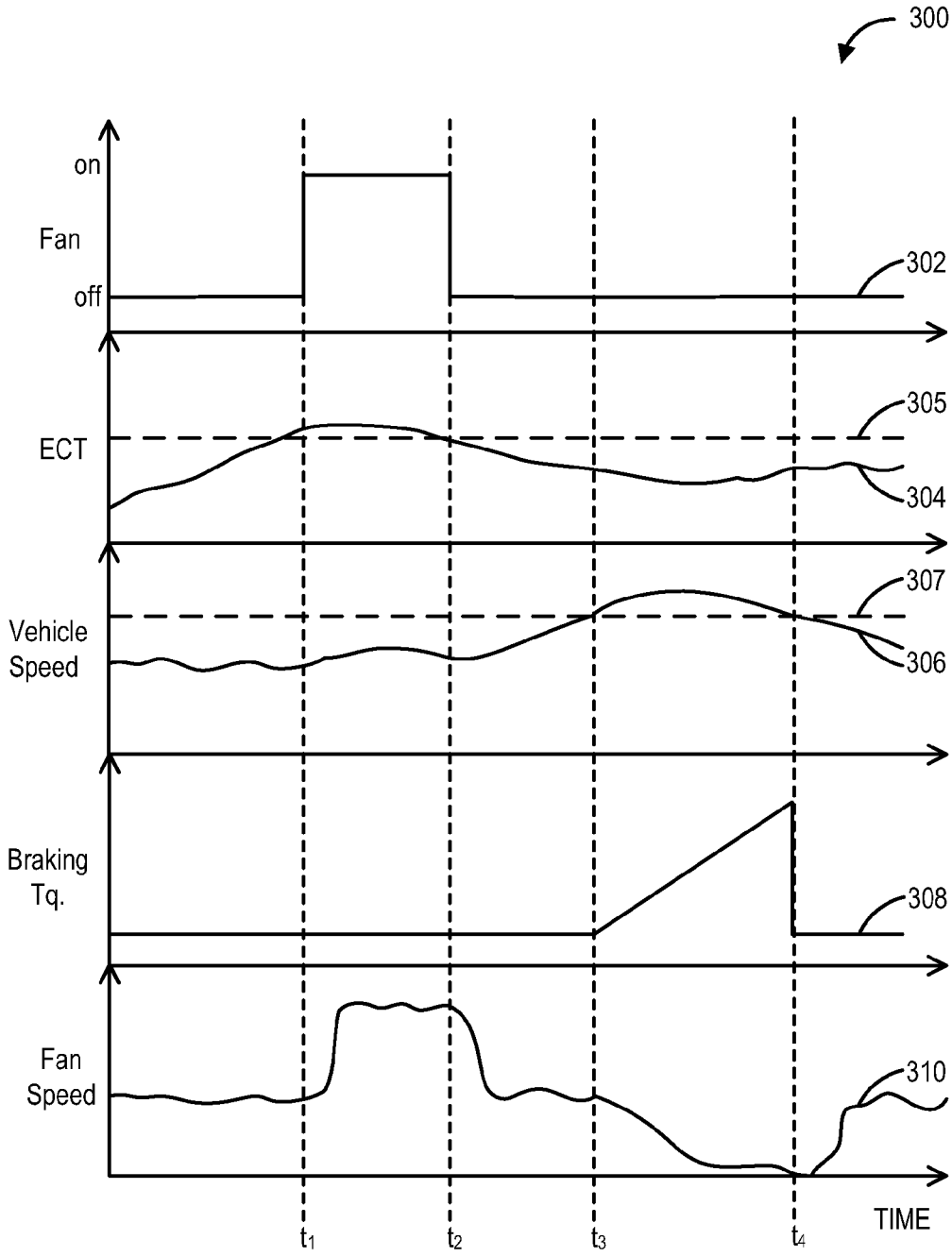
FIG. 3 shows an example cooling fan operation in accordance with the present disclosure.

The following description relates to systems and methods for controlling a cooling fan in a vehicle cooling system, such as the system of FIG. 1. During engine operation, the cooling fan may be driven by the engine to flow cool air through the front end of a vehicle and cool components in the under-hood region. To reduce cooling drag induced by free-wheeling of the fan, during a vehicle moving condition when airflow assistance is not required, based on vehicle operating conditions, a braking torque may be selectively applied to the rotating fan blades to reduce airflow through the fan and under-hood region. An engine controller may perform a control routine, such as depicted in FIG. 2, to either apply a mechanical braking torque or an electrical braking torque, based on the vehicle operating conditions, to thereby stop fan rotation. By reducing fan free-wheeling, air flow through the vehicle cooling system may be reduced when fan operation is not desired. By reducing front-end air flow, cooling drag may be reduced. Example cooling fan operations are illustrated in FIG. 3.

Turning now to FIG. 1, an example embodiment of vehicle cooling system 100 in a motor vehicle 102 is illustrated schematically. Vehicle 102 has drive wheels 106, a passenger compartment 104, and an under-hood compartment 103. Under-hood compartment 103 may house various under-hood components under the hood (not shown) of motor vehicle 102. For example, under-hood compartment 103 may house internal combustion engine 10. Internal combustion engine 10 has a combustion chamber which may receive intake air via intake passage 44 and may exhaust combustion gases via exhaust passage 48. In one example, intake passage 44 may be configured as a ram-air intake wherein the dynamic pressure created by moving vehicle 102 may be used to increase a static air pressure inside the engine's intake manifold. As such, this may allow a greater mass flow of air through the engine, thereby increasing engine power. Engine 10 as illustrated and described herein may be included in a vehicle such as a road automobile, among other types of vehicles. While the example applications of engine 10 will be described with reference to a vehicle, it should be appreciated that various types of engines and vehicle propulsion systems may be used, including passenger cars, trucks, etc.

Under-hood compartment 103 may further include cooling system 100 that circulates coolant through internal combustion engine 10 to absorb waste heat, and distributes the heated coolant to radiator 80 and/or heater core 90 via coolant lines 82 and 84, respectively. In one example, as depicted, cooling system 100 may be coupled to engine 10 and may circulate engine coolant from engine 10 to radiator 80 via engine-driven water pump 86, and back to engine 10 via coolant line 82. Engine-driven water pump 86 may be coupled to the engine via front end accessory drive (FEAD) 36, and rotated proportionally to engine speed via a belt, chain, etc. Specifically, engine-driven pump 86 may circulate coolant through passages in the engine block, head, etc., to absorb engine heat, which is then transferred via the radiator 80 to ambient air. In one example, where pump 86 is a centrifugal pump, the pressure (and resulting flow) produced by the pump may be proportional to the crankshaft speed, which in the example of FIG. 1, may be directly proportional to the engine speed. The temperature of the coolant may be regulated by a thermostat valve 38, located in the cooling line 82, which may be kept closed until the coolant reaches a threshold temperature.

Coolant may flow through coolant line 82, as described above, and/or through coolant line 84 to heater core 90 where the heat may be transferred to passenger compartment 104, and the coolant flows back to engine 10. In some examples, engine-driven pump 86 may operate to circulate the coolant through both coolant lines 82 and 84.

One or more blowers (not shown) and cooling fans may be included in cooling system 100 to provide airflow assistance and augment a cooling airflow through the under-hood components. For example, cooling fan 92, coupled to radiator 80, may be operated when the vehicle is moving and the engine is running to provide cooling airflow assistance through radiator 80. Cooling fan 92 may draw a cooling airflow into under-hood compartment 103 through an opening in the front-end of vehicle 102, for example, through grill 112. Such a cooling air flow may then be utilized by radiator 80 and other under-hood components (e.g., fuel system components, batteries, etc.) to keep the engine and/or transmission cool. Further, the air flow may be used to reject heat from a vehicle air conditioning system. Further still, the airflow may be used to improve the performance of a turbocharged/supercharged engine that is equipped with intercoolers that reduce the temperature of the air that goes into the intake manifold/engine.

Cooling fan 92 may be coupled to, and driven by, engine 10, via alternator 72 and system battery 74. Cooling fan 92 may also be mechanically coupled to engine 10 via an optional clutch 76. During engine operation, the engine generated torque may be transmitted to alternator 72 along a drive shaft (not shown). The generate torque may be used by alternator 72 to generate electrical power, which may be stored in an electrical energy storage device, such as system battery 74. Battery 74 may then be used to operate an electric cooling fan motor 94. Thus, operating the cooling fan may include, mechanically powering cooling fan rotation from engine rotational output via clutch 76, for example, during engine operation. Additionally or optionally, operating the cooling fan may include, electrically powering cooling fan rotation from engine rotational input, through the alternator and system battery, for example, when engine speed is below a threshold (for example, when the engine is in idle-stop). In still another example, the cooling fan may be an electric fan, and operating the cooling fan may include enabling an electric motor coupled to the cooling fan.

An engine controller may adjust the operation of cooling fan 92 based on vehicle cooling demands, vehicle operating conditions, and in coordination with engine operation. In one example, during a first vehicle moving condition, when the engine is operating, and vehicle cooling and airflow assistance from the fan is desired, cooling fan 92 may be operated mechanically (powered by the engine, through the clutch) or electrically (powered by enabling battery-driven electric motor 94), to provide airflow assistance in cooling under-hood components. The first vehicle moving condition may include, for example, when an engine temperature is above a threshold. In another example, during a second vehicle moving condition, when airflow assistance is not desired (for example, due to sufficient vehicle motion-generated airflow through the under-hood compartment), fan operation may be discontinued by disabling the fan motor or uncoupling the fan from the engine. The second vehicle moving condition may further include the engine being deactivated (for example, the engine may be in idle-stop). However, the fan may continue to free-wheel due to the natural flow of ambient air through the fan blades and the influence of the ram air pressure impacting the fan blade surface. The reaction torque of the free-wheeling fan blades may result in a reduced pressure drop across the fan. The reduced pressure drop may reduce cooling system resistance, increase a cooling airflow through the fan, and consequently generate a cooling drag. The resultant increase in aerodynamic drag may reduce the fuel economy of vehicle 102.

Thus, as further elaborated in FIG. 2, during such a (second) vehicle moving condition where the fan is free-wheeling, an engine controller may reduce fan free-wheeling, and the consequent cooling drag, by selectively applying a braking torque on the rotating fan blades based on vehicle operating conditions. The braking torque may be applied using mechanical methods, such as via a mechanical latch or pin. Alternatively, where the cooling fan is an electric motor driven fan, the braking torque may be applied by shorting the fan motor circuit and using the back EMF generated by shorting the motor circuit to stop fan rotation. The amount of braking torque may be adjusted based on vehicle operating conditions. For example, braking torque may be applied (or increased) based on vehicle speed (such as, when vehicle speed is above a threshold speed wherein aerodynamic drag may limit vehicle motion). In another example, braking torque may be applied (or decreased) based on an engine temperature (such as, when engine temperature increased above a threshold).

In still other embodiments, the engine controller may adjust the fan speed and/or braking torque to thereby adjust an amount of cooling drag generated by the rotating fan blades. It will also be appreciated that during other free-wheeling fan conditions, at least some energy from fan braking may be harnessed by operating the fan motor as a generator. The generator may be used to trickle-charge the system battery.

FIG. 1 further shows a control system 14. Control system 14 may be communicatively coupled to various components of engine 10 to carry out the control routines and actions described herein. For example, as shown in FIG. 1, control system 14 may include an electronic digital controller 12. Controller 12 may be a microcomputer, including a microprocessor unit, input/output ports, an electronic storage medium for executable programs and calibration values, random access memory, keep alive memory, and a data bus. As depicted, controller 12 may receive input from a plurality of sensors 16, which may include user inputs and/or sensors (such as transmission gear position, gas pedal input, brake input, transmission selector position, vehicle speed, engine speed, mass airflow through the engine, ambient temperature, intake air temperature, etc.), cooling system sensors (such as coolant temperature, fan speed, passenger compartment temperature, ambient humidity, etc.), and others. Further, controller 12 may communicate with various actuators 18, which may include engine actuators (such as fuel injectors, an electronically controlled intake air throttle plate, spark plugs, etc.), cooling system actuators (such as a mechanical latch or pin coupled to the cooling fan, cooling fan electric motor, motor circuit switch, clutch 76, etc.), and others. In some examples, the storage medium may be programmed with computer readable data representing instructions executable by the processor for performing the methods described below as well as other variants that are anticipated but not specifically listed.

Now turning to FIG. 2, an example routine 200 is described for adjusting operations of a cooling fan during vehicle operation to reduce aerodynamic drag. By reducing the cooling drag component of aerodynamic drag, vehicular fuel economy may be improved.

At 202, it may be confirmed that the vehicle is moving. If the vehicle is not moving, the routine may end. At 203, vehicle operating conditions may be estimated and/or measured. These may include, for example, vehicle speed, engine speed, engine output, engine temperature, engine coolant temperature (ECT), etc. At 204, based on vehicle operation conditions, it may be determined whether airflow assistance is desired. As such, vehicle motion may cause air to enter and flow through the under-hood compartment, and this flow of air may provide some assistance to the cooling system in cooling under-hood components. However, additional airflow assistance may be desired when, for example, a coolant temperature exceeds a threshold value, an intake manifold temperature exceeds a threshold value, a modeled temperature (exhaust, engine oil, etc.) exceeds a threshold value, etc., and the cooling assistance provided by the airflow through the under-hood compartment does not suffice. If airflow assistance is desired, then at 206, one or more cooling fans of the vehicle's cooling system may be operated. In one example, operating a cooling fan may include using the engine to power the fan's rotation. This may include, mechanically powering cooling fan rotation from engine rotational input via a clutch, or electrically powering cooling fan rotation from engine rotational input via an alternator and a system battery. In another example, where the cooling fan is an electric fan, operating the cooling fan may include enabling an electric motor coupled to the fan, and using the motor to power the fan's rotation. The electric motor may be driven, for example, by a system battery. By operating the cooling fan, a cooling air flow may be drawn in from the front-end of the vehicle (e.g., through the grill) and may be delivered to the under-hood components (such as the heated engine, radiator, etc.) to assist in cooling.

If airflow assistance is not requested, that is, if the vehicle-motion induced flow of air through the under-hood compartment is sufficient to assist the cooling system, then at 208, it may be determined if one or more cooling fans are free-wheeling. If no free-wheeling is occurring, the routine may end (that is, the routine may be run one time through) or loop back to the start (that is, the routine may run continuously while the vehicle is moving).

As such, since no airflow assistance is desired, the cooling fan may be disabled or may remain unpowered. This may include, uncoupling the fan from an engine-driven pump, or disabling an electric motor of an electric cooling fan. In one example, the cooling fan may be free-wheeling when the fan is powered off and the vehicle is coasting (for example, engine is deactivated and the vehicle is coasting to a stop). Herein, the pressure of the ram air impacting the fan blade surface may generate a reaction torque which causes the fan to rotate. The free-wheeling effect, in turn, results in a reduced pressure drop across the fan as a whole relative to a stationary fan blade. This reduced pressure drop may result in lower cooling system resistance and more cooling airflow through the under-hood components. The cooling airflow through the cooling fan generates a cooling drag that adds to the unwanted aerodynamic drag of the moving vehicle.

Thus, if one or more cooling fans are free-wheeling during a vehicle moving condition, while no airflow assistance is desired, at 210, an engine controller may selectively apply a braking torque on the rotating blades based on the vehicle operating conditions (such as those estimated at 203). The operating conditions may include at least one of vehicle speed, engine coolant temperature, engine speed, engine output, engine temperature, etc. For example, applying a braking torque in response to operating conditions may include, applying a braking torque when the vehicle speed is above a threshold speed and the engine temperature (or engine coolant temperature) is below a threshold temperature. Applying a braking torque may include applying a mechanical braking torque (at 212) or an electrical braking torque (at 214) in response to operating conditions. Applying a mechanical braking torque at 212 may include, for example, engaging a latch or pin to the rotating fan blades such that the engagement causes the fan rotation to be impeded. Alternatively, when the cooling fan is operated by a battery-powered electric motor, applying an electrical braking torque at 214 may include, for example, shorting a circuit of an electric motor coupled to the fan (such as, the power feed of the fan's motor). Herein, the back EMF generated by the electric motor attached to the free-wheeling fan blades may provide the electrical braking torque and may limit the motor speed to a low value.

In alternate embodiments, the braking torque may be applied with the help of a pulse width modulator (PWM), and applying a braking torque may include adjusting the duty cycle of the PWM to provide the desired braking torque, based on the vehicle operating conditions. In still another embodiment, the braking torque may be applied for a duration based on the vehicle operating conditions. Additionally, the amount of braking torque applied may be adjusted based on the vehicle operating conditions. In one example, applying a braking torque in response to operating conditions may include, increasing a braking torque as the vehicle speed increases and/or engine output increases. Herein, by applying a braking torque, the aerodynamic drag on the vehicle may be reduced as the vehicle speeds up. In another example, applying a braking torque in response to operating conditions may include decreasing a braking torque as the engine temperature and/or coolant temperature increases. Herein, by increasing airflow through the fan, cooling of the engine and/or coolant may be expedited.

In this way, by applying a braking torque, free-wheeling of the cooling fans may be reduced during conditions when airflow assistance is not desired, thereby reducing cooling drag. By reducing aerodynamic drag, vehicular fuel economy may be improved.

While the depicted routine illustrates selectively applying a braking torque when the fan is free-wheeling, it will be appreciated than in other embodiments, during a third vehicle moving condition, when the fan is free-wheeling and a braking torque is applied, an engine controller may be configured to operate the electric motor coupled to the fan (as a generator) to generate electrical energy from the braking of the fan's rotation. The controller may then trickle charge the system battery with the energy generated from the regenerative braking. In one example, when the fan is free-wheeling and the vehicle engine is deactivated (i.e., in idle-stop), for example, when the vehicle is coasting with the driver's foot off the accelerator pedal, a braking torque may be selectively applied on the free-wheeling fan to reduce fan rotation, and the kinetic energy may be used to generate electrical energy that may be stored in the system battery.

In one example, the engine controller may monitor the rotational speed of the fan blades in at least one cooling fan when the fan is free-wheeling. If the rate of deceleration of the blades upon braking torque application is greater than a desired minimum threshold, the fan's electric motor may be enabled as a generator to harness the rotational energy and employ it to trickle charge the system battery. Additionally, the controller may adjust one or more grill shutters of the vehicle's grill to channel the flow of air received through the front end of the vehicle into the cooling fan and other under-hood components. In this way, energy from a free-wheeling fan may be advantageously harnessed, when desired.

In FIG. 3, map 300 depicts various examples of cooling fan and cooling system related operations and behaviors during vehicle motion. Graph 302 depicts a cooling fan operational state (on or off). Graph 304 depicts changes in engine coolant temperature (ECT) while graph 306 depicts changes in vehicle speed. Graph 308 depicts a braking torque applied on the rotating fan while graph 310 depicts changes in fan speed.

At $t_1$, while the vehicle is moving (graph 306), in response to an increase in engine ECT (graph 304) above a predefined threshold 305, the cooling fan may be operated (graph 302), to provide airflow assistance. In one example, an electric motor of an electric cooling fan may be enabled to operate the fan. As such, prior to the fan being operated, the flow of ambient air through the under-hood compartment of the vehicle may cause the fan to rotate. Consequently, the fan may be free-wheeling. In response to active fan operation at $t_1$, the fan speed may increase (graph 310). The fan may be operated for a duration (from $t_1$ to $t_2$) until the engine coolant temperature drops below the threshold, following which fan operation may be discontinued, for example, by disabling the electric motor of the cooling fan. The fan may then resume free-wheeling. As such, the fan speed may be lower during free-wheeling than when actively operated. At $t_3$, while the fan is free-wheeling, in response to a vehicle speed (graph 306) being higher than a threshold speed 307, and engine coolant temperature being lower than the threshold, a braking torque (mechanical or electrical) may be selectively applied (graph 308) on the free-wheeling fan (from which no airflow assistance is requested). The braking torque may thereby reduce a cooling system resistance to airflow generated by the free-wheeling fan blades relative to a stationary fan which is not free-wheeling. The braking torque also serves to reduce airflow through the fan and the under-hood region, thereby reducing cooling drag. The braking torque may be applied for a duration (from $t_3$ to $t_4$) until the vehicle speed drops below the threshold. In response to braking torque application, the fan speed may quickly drop (for example, to zero as shown herein). In one example, during fan braking, at least some of the energy generated by fan braking may be used to generate electrical energy that may be stored on a system battery. At $t_4$, when the braking torque is removed, the fan speed may start free-wheeling again due to the renewed interaction of ram air from the moving vehicle on the fan blades, and the fan speed may correspondingly increase. While the current example illustrates selectively applying a braking torque in response to vehicle speed and engine coolant temperature, in alternate embodiments, the braking torque may be applied or adjusted responsive to one or more alternate vehicle operating conditions.

In this way, during vehicle motion, when airflow assistance is desired (for example, to assist in cooling), a controller may be configured to enable and operate a cooling fan. In comparison, when no airflow assistance is desired, the controller may disable the cooling fan, and allow the fan to free-wheel. Further, based on vehicle operating conditions, a braking torque may be selectively applied on the free-wheeling fan to reduce cooling airflow and thereby reduce aerodynamic drag on the vehicle generated by said airflow.

Note that the example control and estimation routines included herein can be used with various engine and/or vehicle system configurations. Further, this technology can be applied to any type of powertrain including, but not limited to, powertrains associated with pure electric, hybrid electric, plug-in hybrid electric, fuel cell electric, and diesel engine powered vehicles. The specific routines described herein may represent one or more of any number of processing strategies such as event-driven, interrupt-driven, multi-tasking, multi-threading, and the like. As such, various acts, operations, or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated acts or functions may be repeatedly performed depending on the particular strategy being used. Further, the described acts may graphically represent code to be programmed into the computer readable storage medium in the engine control system.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and nonobvious combinations and subcombinations of the various systems and configurations, and other features, functions, and/or properties disclosed herein.

The following claims particularly point out certain combinations and subcombinations regarded as novel and nonobvious. These claims may refer to "an" element or "a first" element or the equivalent thereof. Such claims should be understood to include incorporation of one or more such elements, neither requiring nor excluding two or more such elements. Other combinations and subcombinations of the disclosed features, functions, elements, and/or properties may be claimed through amendment of the present claims or through presentation of new claims in this or a related application.

Such claims, whether broader, narrower, equal, or different in scope to the original claims, also are regarded as included within the subject matter of the present disclosure.

The invention claimed is:

1. A method of controlling a cooling fan of a vehicle cooling system, comprising:

during a first vehicle moving condition, operating the cooling fan; and during a second vehicle moving condition:

disabling the cooling fan without applying a braking torque on the fan, during a first operating condition including a vehicle speed higher than a threshold speed, selectively applying the braking torque on the fan, and during a second operating condition including the vehicle speed lower than the threshold speed, removing the braking torque.

2. The method of claim 1, wherein the first vehicle moving condition includes when an engine temperature is above a threshold temperature.

3. The method of claim 2, wherein applying the braking torque includes applying the braking torque when the vehicle speed is above the threshold speed and the engine temperature is below the threshold temperature.

4. The method of claim 1, wherein operating the cooling fan includes powering cooling fan rotation from engine rotational output.

5. The method of claim 1, wherein the cooling fan is an electric fan and operating the cooling fan includes enabling an electric motor coupled to the cooling fan.

6. The method of claim 1, wherein the second vehicle moving condition includes a vehicle engine being deactivated.

7. The method of claim 6, wherein the second vehicle moving condition further includes when airflow assistance is not desired.

8. The method of claim 1, wherein applying a braking torque includes applying a mechanical braking torque or an electrical braking torque in response to the first operating condition or other operating conditions.

9. The method of claim 8, wherein the operating conditions include at least one of engine temperature, coolant temperature, engine speed, vehicle speed, and engine output, and wherein applying a braking torque in response to the first operating condition or other operating conditions includes, increasing the braking torque as the vehicle speed increases, increasing the braking torque as an engine output increases, and decreasing the braking torque as an engine temperature or coolant temperature increases.

10. The method of claim 8, wherein applying a mechanical braking torque includes engaging a latch or pin to rotating fan blades.

11. The method of claim 8, wherein applying an electrical braking torque includes shorting a circuit of an electric motor coupled to the fan.

12. A method of reducing aerodynamic drag on a vehicle, comprising, during vehicle motion, enabling a cooling fan of a vehicle cooling system when airflow assistance is desired;

disabling the cooling fan of the vehicle cooling system when airflow assistance is not desired; and with the cooling fan disabled, selectively applying a braking torque on a free wheeling cooling fan by engaging a latch or pin to rotating fan blades.

13. The method of claim 12, wherein enabling the fan includes powering cooling fan rotation from engine rotational output or enabling an electric motor coupled to the fan, and wherein disabling the fan includes uncoupling the fan from the engine or disabling the electric motor.

14. The method of claim 13, wherein applying a braking torque includes applying an electrical braking torque by shorting a circuit of the electric motor to use the generated back EMF while free-wheeling to stop fan rotation, the braking torque increased as a vehicle speed and/or engine output increases above a threshold, the braking torque decreased as an engine temperature and/or coolant temperature increases above a threshold.

15. The method of claim 12, wherein the braking torque is increased as a vehicle speed and/or engine output increases, and the braking torque is decreased as an engine temperature and/or coolant temperature increases.

16. The method of claim 12, further comprising selectively applying the braking torque based on vehicle operating conditions.

17. A vehicle cooling system configured to cool vehicle under-hood components including, a cooling fan; and a controller having instructions stored thereon executable to, during a first vehicle moving condition, when airflow assistance is desired, operate the cooling fan;

during a second vehicle moving condition, when airflow assistance is not desired:

disable the cooling fan without applying a braking torque on the fan during a first operating condition including a vehicle speed higher than a threshold speed, selectively apply the braking torque on the fan; and during a second operating condition including the vehicle speed lower than the threshold speed, remove the braking torque.

18. The system of claim 17, wherein applying a braking torque includes applying one of a mechanical braking torque and an electrical braking torque, and adjusting an amount of braking torque applied based on a third operating condition.

* * * * *